US012768117B2

(12) United States Patent
Goegele

(10) Patent No.: US 12,768,117 B2
(45) Date of Patent: Oct. 20, 2026

(54) SNOWBOARD AND/OR SKI JUMPING STRUCTURE AND METHOD OF MAKING SAID STRUCTURE

(71) Applicant: PRINOTH S.P.A., Vipiteno (IT)

(72) Inventor: Johannes Goegele, Vipiteno (IT)

(73) Assignee: PRINOTH S.P.A., Vipitino (IT)

( * ) Notice: Subject to any disclaimer, the term of this patent is extended or adjusted under 35 U.S.C. 154(b) by 728 days.

(21) Appl. No.: 17/983,116

(22) Filed: Nov. 8, 2022

(65) Prior Publication Data

US 2023/0220639 A1 Jul. 13, 2023

(30) Foreign Application Priority Data

Nov. 12, 2021 (IT) ..... 102021000028862

(51) Int. Cl.
*E01H 4/02* (2006.01)
*A63C 19/10* (2006.01)

(52) U.S. Cl.
CPC ..... *E01H 4/02* (2013.01); *A63C 19/10* (2013.01)

(58) Field of Classification Search
None
See application file for complete search history.

(56) References Cited

U.S. PATENT DOCUMENTS

2005/0051687 A1* 3/2005 Richter ..... A63C 19/10 248/229.1
2008/0293506 A1* 11/2008 Northam ..... A63G 31/007 280/616
2009/0040301 A1* 2/2009 Sandler ..... H04N 7/181 348/143
2010/0123777 A1* 5/2010 Stewart ..... H04N 7/18 348/143
2018/0001139 A1* 1/2018 Moyerman ..... G01R 33/02
2018/0005129 A1* 1/2018 Moyerman ..... G06N 5/02
2018/0353842 A1* 12/2018 Jacobson ..... A63C 19/10
(Continued)

FOREIGN PATENT DOCUMENTS

ES 1076848 U * 4/2012
JP 2001070497 A * 3/2001
(Continued)

OTHER PUBLICATIONS

Hubbard, Safer Ski Jump Landing Surface Design Limits Normal Impact Velocity, Journal of ASTM International, vol. 6, No. 1, Paper ID JAI101630, 2009, pp. 1-10. (Year: 2009).*
(Continued)

*Primary Examiner* — Dorothy Harris
(74) *Attorney, Agent, or Firm* — Neal, Gerber & Eisenberg LLP

(57) ABSTRACT

A snowboard and/or ski jumping structure configured to be run along a riding direction and made with snow of a ski area; the snowboard and/or ski jumping structure comprising a ramp, in particular made with snow of the ski area, which comprises a transition zone and a take-off zone, wherein the take-off zone is characterized by a take-off angle at a take-off point of the take-off zone; and a landing zone, particularly made with snow of the ski area, comprising a first zone, such as a sweet-spot zone, and a second zone, such as a critical zone; wherein the sweet-spot zone has variable slopes along the riding direction.

18 Claims, 4 Drawing Sheets

(56) References Cited

U.S. PATENT DOCUMENTS

| | | | | |
|---|---|---|---|---|
| 2022/0417441 | A1* | 12/2022 | Voelker | H04N 5/144 |
| 2023/0220639 | A1* | 7/2023 | Goegele | A63C 19/10 472/88 |
| 2024/0394898 | A1* | 11/2024 | Pedrotti | G06T 7/248 |

FOREIGN PATENT DOCUMENTS

| | | | | |
|---|---|---|---|---|
| KR | 20130117592 | A * | 10/2013 | A63C 19/10 |
| WO | WO-2008122821 | A1 * | 10/2008 | A63C 19/10 |
| WO | WO-2020104860 | A1 * | 5/2020 | E01H 4/02 |
| WO | WO-2023044102 | A1 * | 3/2023 | A63C 19/10 |

OTHER PUBLICATIONS

Joe Pasteris, Understanding Different Types of Skiing, REI Coop Expert Advice Feb. 7, 2018 (Year: 2018).*

Levy et al., A design rationale for safer terrain park jumps that limit equivalent fall height, Sep. 1, 2015, pp. 227-239 (provided on IDS dated Nov. 8, 2022) (Year: 2015).*

Ski Jumping Hills, General Description, Maintained by the Ski Jumping Committee, USSA Eastern Division, Feb. 15, 1997 (Year: 1997).*

FIS Press Release, Aug. 21, 2013, pp. 1-12 (Year: 2013).*

Gasser, Construction Norm, Implementing Provisions for Art. 411 of the ICR Ski Jumping, pp. 1-11 (Year: 2018).*

Gasser, Standards for the Construction of Jumping Hills—2012, pp. 1-23 (Year: 2012).*

Bmallon, OlympStats, Nordic Combined, Ski Jumping, Olympic Ski Jumping Hills, Jan. 6, 2014, pp. 1-5 (Year: 2014).*

Kipp et al., USSA sport education, Course Setting Handbook, 2016, pp. 1-43 (Year: 2016).*

Italian Search Report and Written Opinion for Application No. IT202100028862 dated Jun. 30, 2022.

Levy Dean et al: "A design rationale for safer terrain park jumps that limit equivalent fall height", Sports Engineering, Springer London, London, vol. 18, No. 4, Sep. 1, 2015 (Sep. 1, 2015), pp. 227-239, XP035783477, ISSN: 1369-7072, DOI: 10.1007/S12283-015-0182-6 [retrieved on Sep. 1, 2015].

Petrone Nicola et al: "Designing, building, measuring, and testing a constant equivalent fall height terrain park jump", Sports Engineering, Springer London, London, vol. 20, No. 4, Nov. 1, 2017 (Nov. 1, 2017), pp. 283-292, XP036362738, ISSN: 1369-7072, DOI: 10.1007/S12283-017-0253-Y [retrieved on Nov. 1, 2017].

* cited by examiner

SNOWBOARD AND/OR SKI JUMPING STRUCTURE AND METHOD OF MAKING SAID STRUCTURE

PRIORITY CLAIM

This application claims the benefit of and priority to Italian Patent Application No. 102021000028862, filed on Nov. 12, 2021, the entire contents of which is incorporated herein by reference.

TECHNICAL FIELD

The disclosure relates to a snowboard and/or ski jumping structure, to a snowboard and/or ski run comprising a jumping structure and to a method for making a jumping structure.

BACKGROUND

A snowboard and/or ski jumping structure can usually be configured in different ways, depending on the type of trick, in particular on the type of jump, for which it was created.

Furthermore, the term snow park includes a variety of freestyle facilities, which can be natural (i.e., made with natural or artificial snow), or artificial (i.e., made with prefabricated pieces of materials other than snow and laid in the snow park).

A snow park usually comprises a plurality of freestyle fixtures, usually different from one another, so that snowboarders and/or skiers can perform different tricks while riding in the snow park. As a consequence, a snow park comprises an entry, an exit and a plurality of freestyle fixtures, certain of which are different from one another, between the entry and the exit of the snow park.

Furthermore, a snow park consists of a plurality of jumping slopes, which, in turn, comprise jumping structures built with snow and/or with artificial structures, such as for example boxes, rails or other elements on which snowboarders and/or skiers ride with the board/skis and/or perform tricks.

Furthermore, in a snow park there are, among other things, snowboard and/or ski slopes, which, in turn, comprise one or more snowboard and/or ski jumping structures, also known as jumps, or consisting of steel, plastic or wood, also known as jibs.

Jumping structures entail a flying phase, during which users, also called snowboarders and/or skiers, can perform different tricks, such as for example twists, somersaults, turns or any other type of tricks, such as for example tricks called grabs, spins or flips In particular, the snowboard and/or ski jumping structure comprises a starting area, which has a first portion having a constant slope, in particular a downhill slope, and a second portion following the first portion, which is substantially flat; a ramp, which comprises a transition zone and a take-off zone; a table zone comprising a hillock and a knuckle zone; a landing zone comprising a first zone, also called a sweet-spot zone, and a second zone, also called a critical zone, in particular the first zone comprises a slope having a given angle, which is constant over the entire first zone; and finally an exit zone.

Certain drawbacks of certain of the prior art lies in that snowboard and/or ski jumping structures have a level of risk that increases as the difficulty of the tricks to be performed increases.

SUMMARY

An object of the disclosure is to provide a snowboard and/or ski jumping structure, which reduces the relative risk of accidents for snowboarders and/or skiers.

Another object of the disclosure is to provide a snowboard and/or ski jumping structure which enables users to perform tricks with a relatively high level of difficulty without increasing the relative risk of accidents.

Another object of the disclosure is to provide a snowboard and/or ski jumping structure which enables for a relatively greater flying time compared to certain of the prior art, without increasing the relative risk of accidents compared to certain of the prior art.

According to the disclosure, there is provided a snowboard and/or ski jumping structure configured to be ridden along a riding direction and made with snow in a snow park; the snowboard and/or ski jumping structure comprising a ramp, in particular made with snow, which comprises a transition zone and a take-off zone, wherein the take-off zone is characterized by a take-off angle at a take-off point of the take-off zone; and a landing zone, in particular made with snow, comprising a first zone, such as a sweet-spot zone, and a second zone, such as a critical zone; wherein the first zone has variable slopes along the riding direction.

The disclosure offers a snowboard and/or ski jumping structure which increases the range of speeds in the take-off point without increasing the equivalent falling height in the landing moment and, hence, without increasing the relative risk of accidents. In this way, users can perform jumps with a high level of difficulty without increasing the risk of accidents. As such, based on the variable slope, the landing takes place in a relatively less risky manner, though without decreasing the flying time needed to perform given tricks. In other words, the disclosure offers a relatively wider range of speeds in the take-off point and thus users can perform jumps with a relatively longer flying time compared to certain of the prior art, without increasing the relative risk of accidents compared to certain of the prior art.

Another object of the disclosure is to provide a snowboard and/or ski run, which reduces certain of the drawbacks of certain of the prior art.

Another object of the disclosure is to provide a method for making a snowboard and/or ski jumping structure. According to the disclosure, there is provided a method for making a snowboard and/or ski jumping structure, wherein the jumping structure is configured to be ridden along a riding direction; the method comprising making, on a snow surface and using snow, a snow ramp comprising a transition zone and a take-off zone, wherein the take-off zone is characterized by a take-off angle at the take-off point of the take-off zone; and a landing zone made with snow and comprising a first zone, such as a sweet-spot zone, and a second zone, such as a critical zone; the method comprising the step of making the first zone on the sow surface with variable slopes along the riding direction.

BRIEF DESCRIPTION OF THE DRAWINGS

Further features and advantages of the disclosure will be best understood upon perusal of the following description of non-limiting embodiments thereof, with reference to the accompanying drawing, wherein.

DESCRIPTION OF EMBODIMENTS

Figure 1:
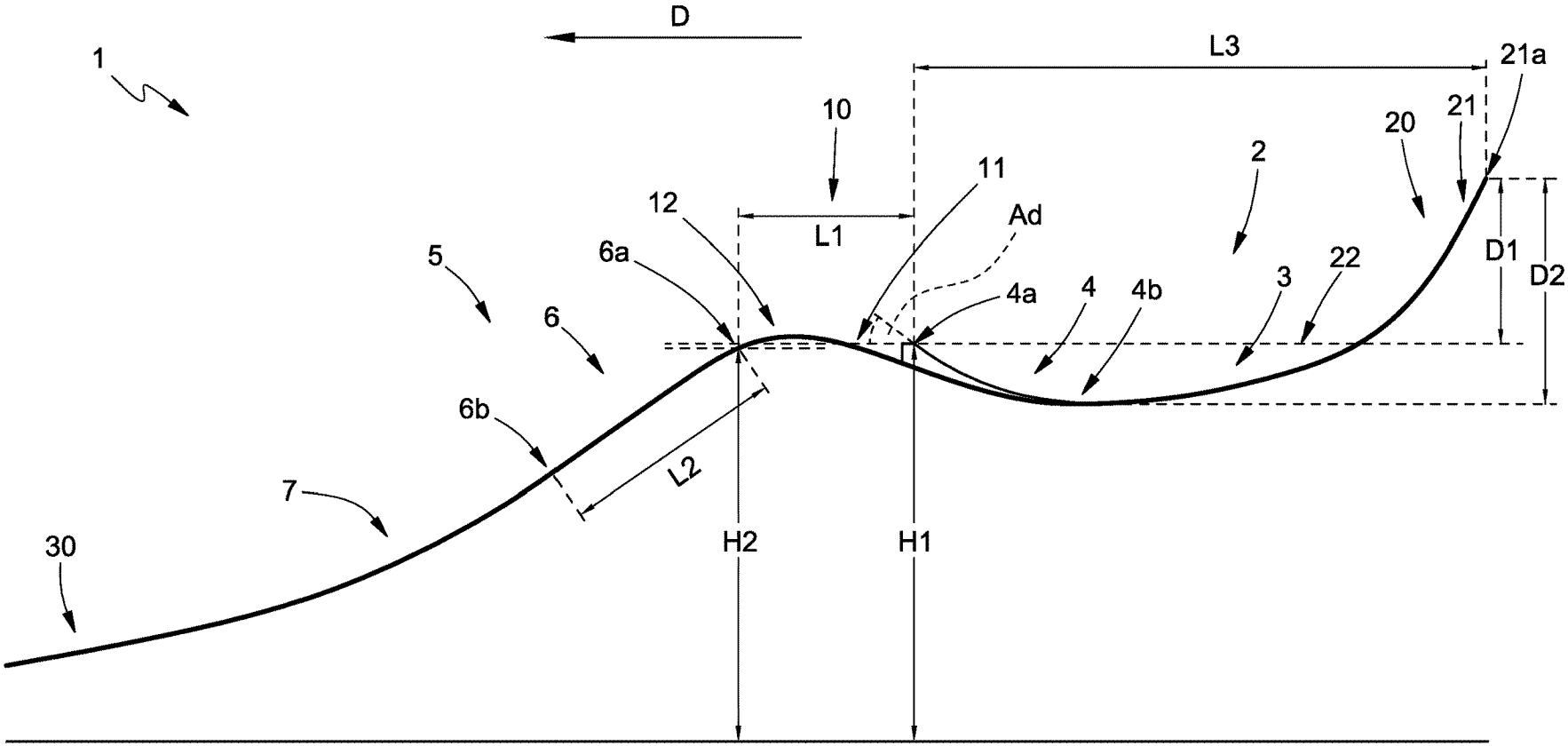
FIG. 1 is a schematic view, with some parts removed for greater clarity, of a snowboard and/or ski jumping structure according to the disclosure.

In FIG. 1, number 1 indicates, as a whole, a snowboard and/or ski jumping structure having a riding direction D. In particular, the snowboard and/or ski jumping structure is made in a ski area and/or in a snow park with the snow of the ski area and/or of the snow park. In other words snow is modelled, such as by a tracked vehicle, in particular a snow groomer, so as to form a snowboard and/or ski jumping structure. As a consequence, the snowboard and/or ski jumping structure is a natural run, or a portion thereof, made with snow. In particular, the snow can be natural snow or artificial snow produced, for example, with snow cannons and/or with snow guns. In an alternative embodiment, the snow can be made of a material, for example a plastic material, simulating snow.

The snowboard and/or ski jumping structure 1 comprises a ramp 2, which, in turn, comprises a transition zone 3 and a take-off zone 4; and a landing zone 5 comprising a zone 6, also called sweet-spot zone 6, and a zone 7, also called critical zone 7.

The ramp 2, in particular the take-off zone 4, is configured for the jump of the snowboarder and/or skier, who usually reaches the ramp 2 with a speed that is already appropriate for the jump. In other words, the ramp 2, in particular the take-off zone 4, is the zone of the run configured to make sure that the snowboarder and/or skier takes off and detaches himself/herself from the snow surface.

In more detail, the take-off zone 4 is characterized by a take-off slope having a take-off angle Ad. The take-off angle Ad is measured in the take-off point 4*a*, namely in the final point of the take-off zone 4. The take-off point 4*a* is the point in which, in use, the snowboarder and/or skier takes off from the snow surface.

The landing zone 5, in particular the zone 6, also known as sweet-spot zone, is the zone that is configured to enable the snowboarder and/or skier to land after having performed the jump. In particular, the snowboard and/or ski jumping structure 1 is configured to enable the snowboarder and/or skier to land in the zone 6, also called the sweet-spot zone, which is the zone deemed to be relatively safe for the landing of the snowboarder and/or skier and where the snowboarder and/or skier is supposed to land, in use. In other words, the zone 6 is the zone where the equivalent falling height is minimum.

Figure 2:
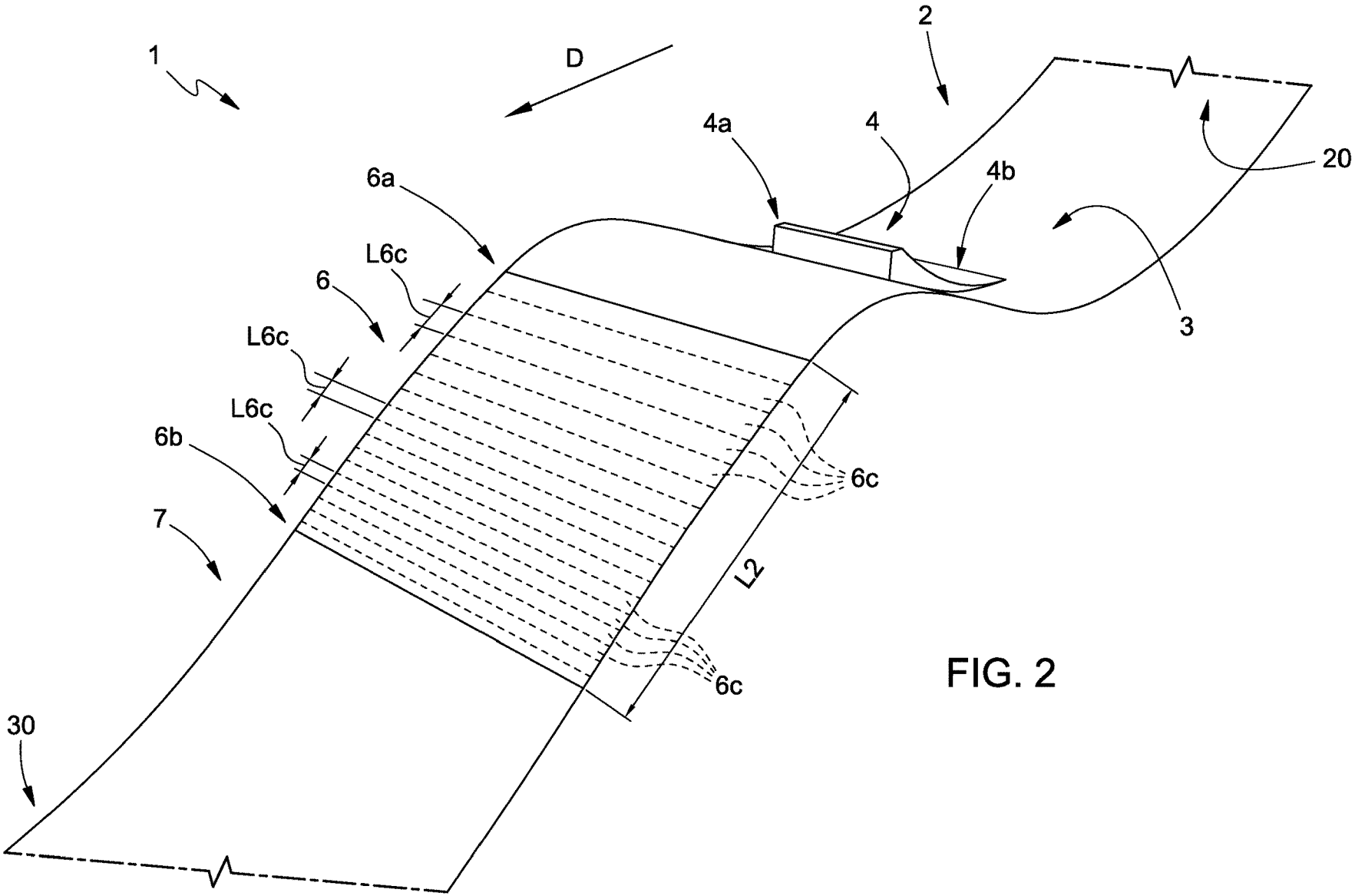
FIG. 2 is a perspective view, with parts removed for greater clarity, of the jumping structure of FIG. 1.
Figure 3:
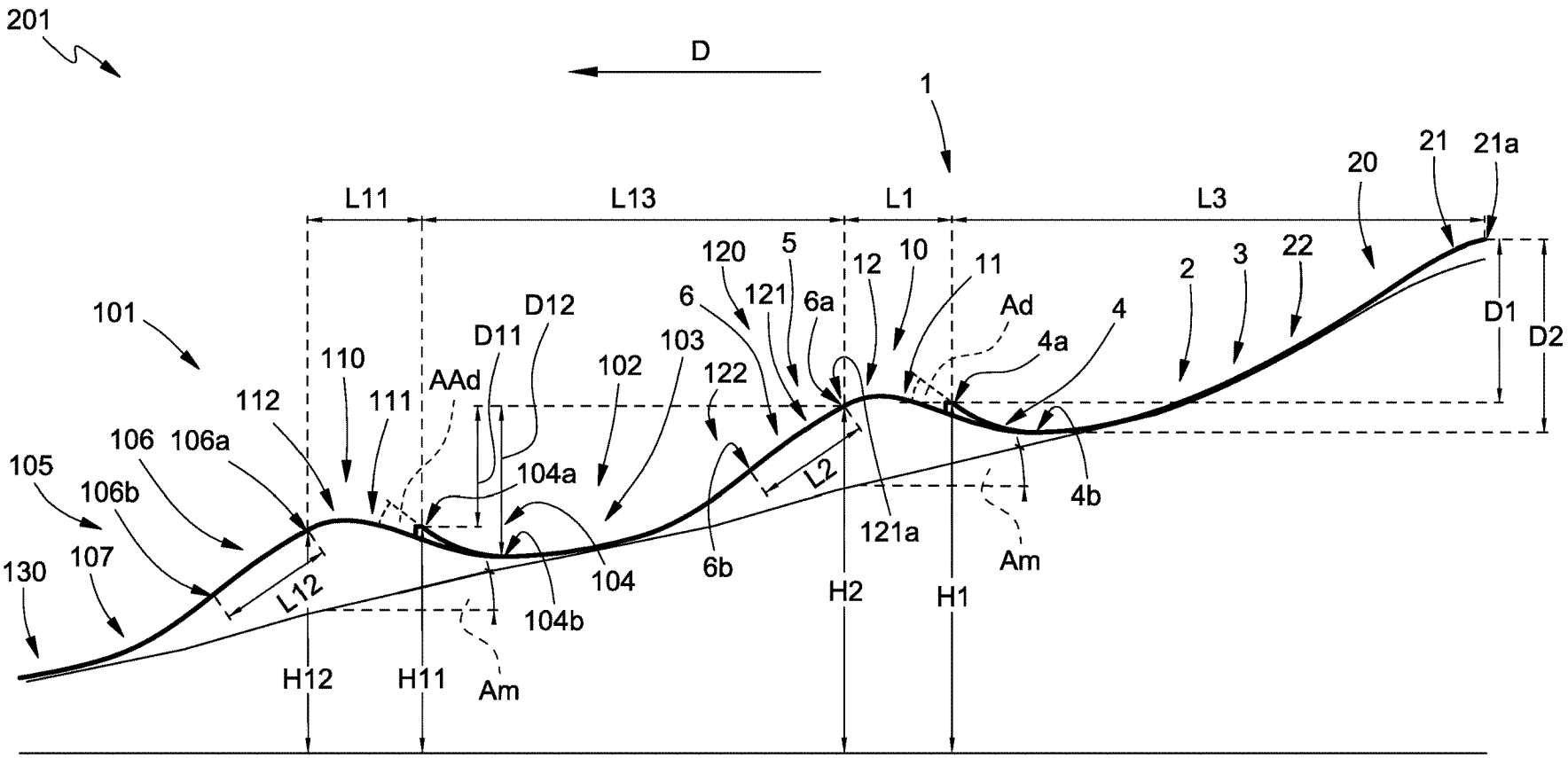
FIG. 3 is a schematic view, with parts removed for greater clarity, of a snowboard and/or ski run according to the disclosure.

With reference to FIGS. 1 to 3, the snowboard and/or ski jumping structure 1 comprises a table 10 arranged between the take-off zone 2 and the landing zone 5. In particular, the table 10 comprises a hillock 11 and a knuckle zone 12, in particular the hillock 11 is arranged before the knuckle zone 12 relative to the riding direction D.

The knuckle zone 12 is a point or zone of convexity of the snowboard and/or ski jumping structure 1. In particular, it is the point or the zone where the slope of the snowboard and/or ski jumping structure 1 changes. That is, the knuckle zone 12 is the point or zone where the slope changes from an uphill slope to a downhill slope relative to the riding direction D. Furthermore, the hillock 11 is adjacent to the take-off zone 2. The knuckle zone 12 is adjacent to the landing zone 5.

With reference to the accompanying figures, the snowboard and/or ski jumping structure 1 comprises a starting area 20 configured to enable the snowboarder and/or skier to gain speed and arranged before the ramp 2, in particular before the transition zone 3, relative to the riding direction D. In this way, the snowboarder and/or skier reaches the ramp 2, in particular the transition zone 3 and, subsequently, the take-off zone 4, with a speed that its suitable to take off in the take-off point 4*a*.

In particular, the starting area 20 has a first portion 21 having a first slope, which in certain instances—though not necessarily—is constant. In particular, the first portion is a downhill slope relative to riding direction D in which it is ridden. The starting area 20 has a second portion 22 following the first portion 21, relative to the riding direction D, which is flat or has a second slope, which is smaller than the first slope.

In particular, the starting area 20, in particular the first portion 21, has an initial point 21*a* where the snowboard and/or ski jumping structure 1 begins.

With reference to the accompanying figures, the snowboard and/or ski jumping structure 1 comprises an exit zone 30 arranged after the landing zone 5 relative to the riding direction D in which it is ridden. In particular the exit zone 30 is arranged after the zone 7 relative to the riding direction D.

Furthermore, with reference to FIG. 1, one of the features of the snowboard and/or ski jumping structure 1 according to the disclosure is that the starting point 6*a* of the zone 6 is at +/−1 meter relative to the height of the take-off point 4*a* of the take-off zone 4 or is at the same height.

In certain, though non-limiting embodiments of the disclosure, the table 10 extends over a length L1 ranging from 10 to 24 meters, in particular from 15 meters to 19 meters, in particular from 16 meters to 18 meters, in particular from 16.5 meters to 17.7 meters, in particular equal to 16.6+/−0.1 meter or to 17.6 meters+/−0.1 meter. The length L1 is measured parallel to the riding direction D. In other words, the length L1 is an aerial distance between the take-off point 4*a* and the initial point 6*a*.

In more detail, the initial point 6*a* of the zone 6 is the first point of the zone 6 relative to the riding direction D. As a consequence, the initial point 6*a* is adjacent to the table 10, in particular to the knuckle zone 12. In other words, the take-off point 4*a* is at a height H1. The initial point 6*a* of the zone 6 is at a height H2. The heights H1 and H2 are measured with respect to a same base reference. The height H1 has a value equal to the height H2. Alternatively, the height H1 and the height H2 have a difference of less than +/−1 m.

Furthermore, since the table 10 extends between the take-off zone 4 and the zone 6, the length L1 of the table 10 can also be measured as linear distance between the take-off point 4*a* and the initial point 6*a* of the zone 6.

In certain, though non-limiting embodiments of the disclosure, the starting area 20 and the ramp 4 extend, as a whole, over a length L3. In particular, the length L3 is measured between the initial point 21*a* and the take-off point 4*a*. In particular, the length L3 is measured parallel to the riding direction D. In other words, the length L3 is an aerial distance between the initial point 21*a* and the take-off point 4*a*. In certain embodiments, the overall length L3 of the starting area 20 and of the ramp 4 ranges from 40 to 120 meters, in particular from 60 to 86 meters, in particular from 64 to 82 meters, in particular is equal to 81 meters+/−1 meter.

Furthermore, the initial point 21*a* is arranged at a higher height than the take-off point 4*a*. As a consequence, there is a height difference D1 between the initial point 21*a* and the take-off point 4*a*.

The height difference D1 is related to the length L3 and to the height D2.

Furthermore, the height difference D1 has a value contained in a range ranging from 13 to 45 meters, in particular from 20 to 30 meters and, in particular, is equal to 25 meters+/−0.5 meters.

Furthermore, the initial point 21*a* is arranged at a higher height than an initial point 4*b* of the ramp 4. As a consequence, there is a height difference D2 between the initial point 21*a* and the take-off point 4*b*.

Furthermore, the height difference D2 has a value contained in a range ranging from 15 to 50 meters, in particular from 25 to 35 meters and, in particular, is equal to 29.5 meters or 29.6 meters or 29.7 meters or 29.8 meters.

With reference to FIG. 2, the zone 6 of the landing zone 5 has a variable slope, in particular the zone 6 has a plurality of slope angles depending on the points of the landing zone 5 along the riding direction D.

In particular, the landing zone 5, especially the zone 6, has a curved profile, which has an exponential trend along the riding direction D.

In more detail, the zone 6 has variable slopes ranging from 25 to 45 degrees, in particular from 28 to 40 degrees, and more particularly from 30 to 39 degrees.

The zone 6 of the landing zone 5 has, in certain instances, a variable slope, in particular a downhill slope relative to the riding direction D, which increases as the riding direction increases.

In particular, the zone 6 has a slope, in the initial point 6*a* of the zone 6, ranging from 28 to 32 degrees.

In particular, the zone 6 has a final slope, in the final point 6*b* of the zone 6, ranging from 36 to 40 degrees. The final point 6*b* is the point where the zone 6 ends and the zone 7 begins. As a consequence, it is the final point 6*b*, relative to the riding direction D, in which a snowboarder and/or skier is supposed to land, in particular it is the final point, relative to the riding direction D, for which the structure 1 is configured for the landing of a snowboarder and/or skier so as to minimize accident risks.

Furthermore, with reference to FIG. 2, the zone 6 is divided into a plurality of segments 6*c*, wherein each segment 6*c* extends over a width perpendicular to the riding direction D. The plurality of segments 6*c* are aligned along the riding direction D. In certain embodiments, each segment 6*c* has a different slope than the previous one and the following one relative to the riding direction D. In particular, the following segment 6*c* has a greater slope than the previous segment 6*c* relative to the riding direction D.

In particular, each segment 6*c* extends over a length L6*c*. The length L6*c* of each segment 6*c* is different from the length of the previous segment L6*c* or of the following segment L6*c*.

In certain embodiments, said length L6*c* is measured as (minimum) linear distance moving within the segment 6*c*. In other words, it is measured as the (minimum) linear distance covered in a segment 6*c* by moving in the riding direction D along the shortest path within the segment 6*c*.

Furthermore, the length L6*c* is a dimension perpendicular to the aforesaid width of the segment 6*c*.

Figure 4:
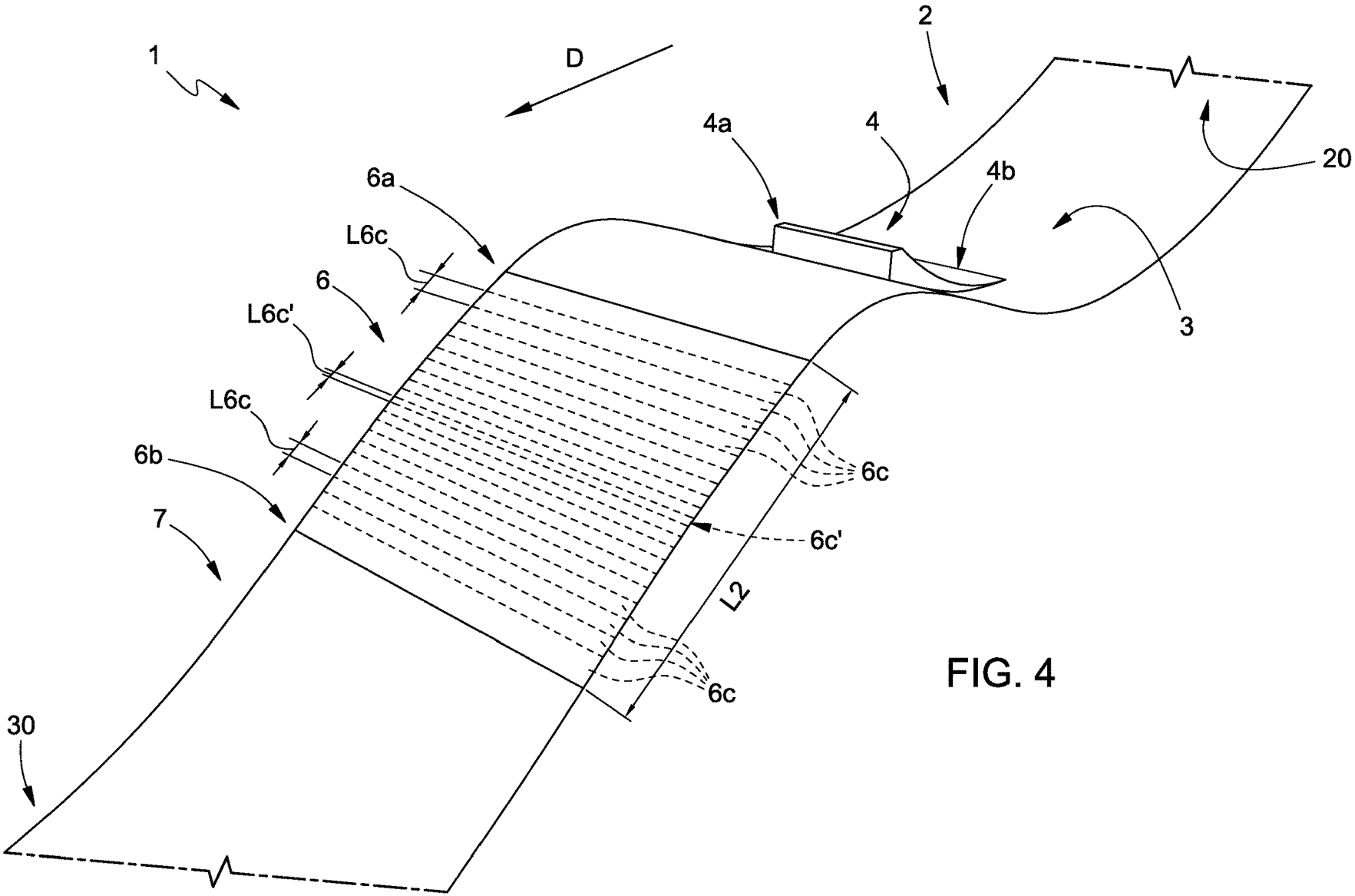
FIG. 4 is a perspective view, with parts removed for greater clarity, of an alternative embodiment of the jumping structure of FIG. 1.

In certain non-limiting embodiments of the disclosure shown in FIG. 4, the length L6*c* of each segment 6*c* is different from the length of the previous segment L6*c* or of the following segment L6*c*. In particular, the zone 6 comprises a first group of segments 6*c*, which are aligned with one another and in which each segment 6*c* is adjacent to another segment 6*c* of the first group of segments 6*c*. The length of each segment 6*c* of the first group of segments 6*c* is smaller than the previous segment 6*c* of the first group of segments 6*c* and/or the length of each segment 6*c* of the first group of segments 6*c* is greater than the following segment 6*c* of the first group of segments 6*c*.

Furthermore, in the embodiment of FIG. 4, the zone 6 comprises a second group of segments 6*c*, which are aligned with one another and in which each segment 6*c* is adjacent to another segment 6*c* of the second group of segments 6*c*. The length of each segment 6*c* of the second group of segments 6*c* is greater than the previous segment 6*c* of the second group of segments 6*c* and/or the length of each segment 6*c* of the second group of segments 6*c* is smaller than the following segment 6*c* of the second group of segments 6*c*. In other words, the plurality of segments 6*c* of the zone 6, in a first portion of the zone 6, decrease in length L6*c* along the riding direction D, such as starting from the initial point 6*a* or from the segment 6*c* following the segment 6*c* of the initial point 6*a* up to a segment 6*c*' having the smallest length L6*c*' of all segments 6*c* and, in a second portions portion of the zone 6, increase in length L6*c* along the riding direction D starting from the segment 6*c*' having the smallest length L6*c* such as up to the final point 6*b* or to the segment preceding the segment of the final point 6*b* of the zone 6.

With reference to FIGS. 1 and 2, the zone 6 has a length L2 ranging from 14 meters to 22 meters, in particular from 16 meters to 20 meters, in particular, in the non-limiting example of the disclosure shown herein, equal to 18 meters. The length is measured as linear distance between the initial point 6*a* of the zone 6 and the final point 6*b* of the zone 6. In other words, it is measured as the distance ridden on the structure 1 in order to go from the initial point 6*a* to the final point 6*b*.

Furthermore, the take-off angle Ad in the take-off point 4*a* ranges from 32° to 43°, in particular from 35° to 39°, and in certain instances, the take-off angle in the take-off point is 37°.

It should be appreciated that the equivalent falling height of the snowboarder and/or skier is relatively smaller compared to certain of the prior art and this makes the snowboard and/or ski jumping structure 1 relatively less dangerous compared to the prior art, but, at the same time, suited for the tricks of the snowboarder and/or skier. In other words, the zone 6 has a greater length without significantly increasing the equivalent falling height and, as a consequence, the snowboard and/or ski jumping structure is relatively safer for snowboarders and/or skiers and has relatively smaller risks of accidents than certain of the prior art.

Furthermore, the flying time is appropriate for performing tricks without increasing the relative risk of accidents, sometimes even longer compared to certain of the prior art. In other words, the snowboard and/or ski jumping structure has increased flying times, given the same equivalent falling heights in the zone 6, compared to certain of the prior art or has lower equivalent falling heights, given the same flying times, compared to certain of the prior art. This leads to relatively smaller risks of accidents for snowboarders and/or skiers without decreasing the possibility of performing tricks.

With reference to FIG. 3, number 201 indicates, as a whole, a snowboard and/or ski jumping rum comprising the snowboard and/or ski jumping structure 1 and a further snowboard and/or ski jumping structure 101. In certain embodiments, the jumping structures 1 and 101 are made on a snow surface having a slope Am ranging from 10 to 20 degrees, in particular of 15 degrees.

The jumping structure 101 is similar, in terms of conformation, to the jumping structure 1.

In particular, the snowboard and/or ski jumping structure 101 comprises a ramp 102, which, in turn, comprises a transition zone 103 and a take-off zone 104; and a landing zone 105 comprising a zone 106, also called a sweet-spot zone, and a zone 107, also called a critical zone.

In more detail, the take-off zone 104 is characterized by a take-off slope having a take-off angle AAd. The take-off angle AAd is measured in the take-off point 104*a*, namely in the final point of the take-off zone 104. The take-off point 104*a* is the point in which, in use, the snowboarder and/or skier takes off from the snow surface.

With reference to FIG. 3 and similarly to the snowboard and/or ski jumping structure 1, the snowboard and/or ski jumping structure 101 comprises a table 110 arranged between the take-off zone 102 and the landing zone 105. In particular, the table 110 comprises a hillock 111 and a knuckle zone 112, in particular the hillock 111 is arranged before the knuckle zone 112 relative to the riding direction D.

The knuckle zone 112 is a point or zone of convexity of the snowboard and/or ski jumping structure 101. In particular, it is the point or the zone where the slope of the snowboard and/or ski jumping structure 101 changes. That is, the knuckle zone 112 is the point or zone where the slope changes from an uphill slope to a downhill slope relative to the riding direction D. Furthermore, the hillock 111 is adjacent to the take-off zone 102. The knuckle zone 112 is adjacent to the landing zone 105.

With reference to the accompanying figures, the snowboard and/or ski jumping structure 101 comprises a starting area 120 configured to enable the snowboarder and/or skier to gain speed and arranged before the ramp 102, in particular before the transition zone 103, relative to the riding direction D. In this way, the snowboarder and/or skier reaches the ramp 102, in particular the transition zone 103 and, subsequently, the take-off zone 104, with a speed that its suitable to take off in the take-off point 104*a*.

In more detail, the starting area 120, in particular the first portion 121, comprises an initial point 121*a*, which is the point where the structure 101 begins. In more detail, the starting area 120 is not similar to the starting area 20 for, in this area, the snowboarder and/or skier arrives with an already gained speed and, hence, does not start from a standing position, which, on the other hand, is the case in the starting area 20. In other words, the structure 101 is configured so that the snowboarder and/or skier, when reaching the starting area 120, already has a given or designated speed, which was previously gained in the structure 1, and does not start from a standing position. For instance, if the snowboarder and/or skier falls, he/she has to leave the run 102 and cannot continue on the structure 101, because he/she could not complete the trick on the structure 101, if he/she started from a standing position in the starting area 120.

In more detail, the starting point 121*a* of the starting area 120 of the structure 101 corresponds to the initial point 6*a* of the zone 6 of the structure 1.

With reference to the accompanying figures, the snowboard and/or ski jumping structure 101 comprises an exit zone 130 arranged after the landing zone 105 relative to the riding direction D in which it is ridden, in particular the exit zone 130 is arranged after the zone 107 relative to the riding direction D.

Furthermore, the snowboarder and/o skier can always leave the structure 1 and/or 101 and/or the run 201 from the side and crosswise to the riding direction D.

Furthermore, with reference to FIG. 1, one of the features of the snowboard and/or ski jumping structure 101 according to the disclosure is that the starting point 106*a* of the zone 106 is at +/−1 meter relative to the height of the take-off point 104*a* of the take-off zone 104.

In more detail, the initial point 106*a* of the zone 106 is the first point of the zone 106 relative to the riding direction D. As a consequence, the initial point 106*a* is adjacent to the table 110, in particular to the knuckle zone 112. In other words, the take-off point 104*a* is at a height H11. The initial point 6*a* of the zone 6 is at a height H12. The heights H11 and H12 are measured with respect to a same base reference. The height H11 has a value equal to the height H12. Alternatively, the height H11 and the height H12 have a difference of less than +/−1 m.

Furthermore, since the table 110 extends between the take-off zone 104 and the zone 106, the length L11 of the table 110 can also be measured as linear distance between the take-off point 104*a* and the initial point 106*a* of the zone 106.

In certain, though non-limiting embodiments of the disclosure, the table 110 extends over a length L11 ranging from 10 to 24 meters, in particular from 15 meters to 19 meters, in particular from 16 meters to 18 meters, in particular from 16.5 meters to 17.7 meters, in particular equal to 16.6+/−0.1 meter or to 17.6 meters+/−0.1 meter. The length L11 is measured parallel to the riding direction D. In other words, the length L11 is measured as aerial distance between the take-off point 104*a* and the initial point 106*a*.

In certain, though non-limiting embodiments of the disclosure, the starting area 120 and the ramp 104 extend, as a whole, over a length L13. In particular, the length L13 is measured between the initial point 121*a* and the take-off point 104*a*. In particular, the length L13 is measured parallel to the riding direction D. In other words, the length L13 is an aerial distance between the initial point 121*a* and the take-off point 104*a*. In certain embodiments, the overall length L13 of the starting area 120 and of the ramp 104 ranges from 50 to 100 meters, in particular from 60 to 86 meters, in particular from 64 to 82 meters, in particular is equal to 64.9 meters+/−1 meter.

As mentioned above, the initial point 121*a* of the starting area 21 of the structure 101 corresponds to the initial point 6*a* of the zone 6 of the structure 1. As a consequence, the length L12 also measures the distance between the initial point 6*a* of the structure 1 and the take-off point 104 of the structure 104.

Furthermore, the initial point 121*a* is arranged at a higher height than the take-off point 104*a*. As a consequence, there is a height difference D11 between the initial point 121*a* and the take-off point 104*a*.

The height difference D11 is related to the length L13 and to the height D12.

Furthermore, the height difference D11 has a value contained in a range ranging from 10 to 40 meters, in particular from 15.5 to 21.5 meters and, in particular, is equal to 18.5 meters+/−0.5 meters.

As mentioned above, the initial point 121*a* of the starting area 21 of the structure 101 corresponds to the initial point 6*a* of the zone 6 of the structure 1. As a consequence, the height difference D11 also measures the height difference between the initial point 6*a* of the structure 1 and the take-off point 104*a* of the structure 101.

Furthermore, the initial point 121*a* is arranged at a higher height than an initial point 104*b* of the ramp 104. As a consequence, there is a height difference D12 between the initial point 121*a* and the take-off point 104*b* of the ramp 104.

Furthermore, the height difference D12 has a value contained in a range ranging from 12 to 47 meters, in particular from 20 to 26 meters and, in particular, is equal to 23 meters or 23.1 meters or 23.2 meters or 23.3 meters.

As mentioned above, the initial point 121*a* of the starting area 21 of the structure 101 corresponds to the initial point 6*a* of the zone 6 of the structure 1. As a consequence, the height difference D12 also measures the height difference between the initial point 6*a* of the structure 1 and the initial point 104*a* of the ramp 104 of the structure 101.

The zone 106 of the landing zone 105 has a variable slope. In particular the zone 106 has a plurality of slope angles depending on the points of the landing zone 105 along the riding direction D.

The zone 106 of the landing zone 105 has a variable slope. In particular the zone 106 has a plurality of slope angles depending on the points of the landing zone 105 along the riding direction D.

In particular, the landing zone 105, especially the zone 106, has a curved profile, which has an exponential trend along the riding direction D.

In more detail, the zone 106 has variable slopes ranging from 25 to 45 degrees, in particular from 28 to 40 degrees, such as from 30 to 39 degrees.

The zone 106 of the landing zone 105 has, in certain instances, a variable slope, in particular a downhill slope relative to the riding direction D, which increases as the riding direction increases.

In particular, the zone 106 has a slope, in the initial point 6*a* of the zone 106, ranging from 28 to 32 degrees.

In particular, the zone 106 has a final slope, in the final point 106*b* of the zone 106, ranging from 36 to 40 degrees. The final point 106*b* is the point where the zone 106 ends and the zone 107 begins. As a consequence, it is the final point 106*b*, relative to the riding direction D, in which a snowboarder and/or skier is supposed to land, in particular it is the final point, relative to the riding direction D, for which the structure 101 is configured for the landing of a snowboarder and/or skier so as to minimize accident risks.

Furthermore, with reference to FIG. 2, similarly to the zone 6 of the structure 1, the zone 106 is divided into a plurality of segments (which are not shown in the drawings, but are similar to the ones shown in FIG. 2), wherein each segment extends over a width perpendicular to the riding direction D, said plurality of segments being aligned along the riding direction D. In certain embodiments, each segment has a different slope than the previous one and the following one relative to the riding direction D. In particular, the following segment has a greater slope than the previous segment relative to the riding direction D.

With reference to FIG. 3, the zone 106 has a length ranging from 14 meters to 22 meters, in particular from 16 meters to 20 meters, in particular, in the non-limiting example of the disclosure shown herein, equal to 18 meters. The length is measured as linear distance between the initial point 106*a* of the zone 106 and the final point 106*b* of the zone 106. In other words, it is measured as the distance ridden on the structure 101 in order to go from the initial point 106*a* to the final point 106*b*.

Furthermore, the take-off angle AAd in the take-off point 104*a* ranges from 32° to 43°, in particular from 35° to 39°, such as the take-off angle in the take-off point is 37°.

As such, the equivalent falling height of the snowboarder and/or skier is smaller compared to certain of the prior art and this makes the snowboard and/or ski jumping structure 1, 101 as well as the jumping run relatively less dangerous compared to certain of the prior art, but, at the same time, suited for the tricks of the snowboarder and/or skier. In other words, the zones 6 and 106 have a greater length without significantly increasing the equivalent falling height and, as a consequence, the snowboard and/or ski jumping structures and the jumping run are relatively safer for snowboarders and/or skiers and have relatively smaller risks of accidents than certain of the prior art.

Furthermore, the flying time is appropriate for performing tricks without increasing the relative risk of accidents, sometimes even longer compared to certain of the prior art. In other words, the jumping run comprising two or more snowboard and/or ski jumping structures has increased flying times, given the same equivalent falling heights in the zones 6 and 106, compared to certain of the prior art or has lower equivalent falling heights, given the same flying times, compared to certain of the prior art. This leads to smaller relative risks of accidents for snowboarders and/or skiers without decreasing the possibility of performing tricks.

FIG. 3 shows a jumping run with two jumping structures. It should be appreciated that this is a mere example and the jumping run can have a plurality of jumping structures arranged one after the other and with the same height and length ratios explained for the jumping structure 1 and the jumping structure 101. In other words, the jumping run can comprise three jumping structures or four jumping structures or five jumping structures and so on having the same analogies and the same relationships/ratios between one jumping structure and the following one as between the jumping structure 1 and the jumping structure 101.

In certain embodiments, one or more snowboard and/or ski jumping structures 1 and 101 and one or more jumping runs 2 and 201 comprising the structures are made by a groomer vehicle comprising a control unit, which comprises, in turn, a memory where a map is stored. The groomer vehicle comprises snow processing tools, such as for example a shovel and/or a tiller. The memory of the control unit comprises a map where there are stored geographical coordinates associated with instructions for the snow processing tools. The groomer vehicle comprises a geographical coordinate detecting device.

In use, the control unit is configured to define the position and the parameters of one or more processing tools based on the instructions contained in the map and on the geographical coordinates detected by the geographical coordinate detecting device.

The groomer vehicle comprises a screen connected, through data connection, to the control unit in order to receive the position and the parameters of the tools defined by the control unit and display them, on the screen, to an operator of the groomer vehicle, who, in turn, will implement them.

In an alternative embodiment, the control unit is connected, through communication, to one or more processing tools and controls, such as in a direct manner, the position and the parameters of one or more of the tools based on the position and on the parameters defined above.

In particular, the control unit detects the current geographical coordinates of where the groomer vehicle is located and obtains, from the memory, the instructions to be implemented for the snow processing tools based on the detected geographical coordinates, in particular by selecting the instructions associated with the geographical coordinates detected in the map. Finally, the control unit is configured to display the instructions on the screen or to implement them with the tools, said instructions containing, in particular, parameters, such as for example position and moving speed of the tools or of parts thereof, obtained from the map and from the geographical coordinates associated with them.

In certain embodiments, the groomer vehicle comprises a snow depth detecting device. In this embodiment, the control unit is configured to define the instructions to be displayed on the screen or to be implemented with the snow processing tools based on the instructions stored in the memory and/or on the detected geographical coordinates and on the detected snow depth.

In particular, the instructions of the control device comprise instructions to make the jumping structure 1 and/or 101 and/or the jumping run 201 comprising one or more of the jumping structures 1 and/or 101. In particular, the jumping structure 1 and/or 101 and/or the jumping run 201 are made by modelling snow through the use of at least one snow processing tool, such as the shovel and/or the tiller, of a groomer vehicle and the run is made on a snow surface, such as in an automatic or semi-automatic manner through the instructions stored in the control device of the groomer vehicle.

Finally, the jumping structure and/or the jumping run can also be made during an event, laying them on a support structure, for example a scaffolding.

The disclosure also applies to embodiments that are not explicitly described in the detailed description and/or to equivalent embodiments defined by the scope of protection of the appended claims. Accordingly, various changes and modifications to the presently disclosed embodiments will be apparent to those skilled in the art.

The invention claimed is:

1. A jumping structure comprising:

a ramp made with snow and comprising a transition zone, and a take-off zone defined by a take-off angle at a take-off point of the take-off zone; and a landing zone associated with the ramp and made with snow, the landing zone comprising a first zone and a second zone, wherein:

the first zone defines a plurality of variable slopes along a riding direction, the first zone comprises a plurality of segments aligned along the riding direction, each segment extending a length along a dimension, wherein the length along the dimension of each segment is at least one of different from the length along the dimension of a previous segment relative to the riding direction and different from the length along the dimension of a following segment relative to the riding direction, and the plurality of segments comprise:

a first group of segments, wherein the length along the dimension of each segment of the first group of segments is at least one of:

smaller than the length along the dimension of the previous segment relative to that segment along the riding direction, and greater than the length along the dimension of the following segment relative to that segment along the riding direction, and a second group of segments, wherein the length along the dimension of each segment of the second group of segments is at least one of:

greater than the length along the dimension of the previous segment relative to that segment along the riding direction, and smaller than the length along the dimension of the following segment relative to that segment along the riding direction.

2. The jumping structure of claim 1, wherein the plurality of variable slopes are each in a range of 25 degrees to 45 degrees.

3. The jumping structure of claim 1, wherein the first zone defines a variable slope that increases along the riding direction.

4. The jumping structure of claim 1, wherein one of: a start point of the first zone, relative to the riding direction, is at a same altitude as the take-off point, and a difference in altitudes between the start point of the first zone and the take-off point is no more than one meter.

5. The jumping structure of claim 1, wherein the first zone has a curved profile along the riding direction.

6. The jumping structure of claim 1, wherein the take-off angle at the take-off point is in a range of 32 degrees to 43 degrees.

7. The jumping structure of claim 1, wherein the first zone of the landing zone has a length in a range of 14 meters to 22 meters.

8. The jumping structure of claim 1, further comprising a table comprising a hillock and a knuckle zone arranged between the take-off zone and the landing zone, wherein the table extends for a length in a range of 10 meters to 24 meters.

9. The jumping structure of claim 1, further comprising a starting area defining a first portion having a first slope relative to the riding direction and a second portion following the first portion relative to the riding direction which has a second slope less than the first slope.

10. The jumping structure of claim 1, further comprising an exit zone located after the landing zone with respect to the riding direction.

11. The jumping structure of claim 1, wherein each segment of the first zone defines a different slope than a previous segment relative to the riding direction and a following segment relative to the riding direction.

12. A jump slope comprising:

a first jumping structure comprising:

a first ramp made with snow and comprising a first transition zone, and a first take-off zone defined by a first take-off angle at a first take-off point of the first take-off zone; and a first landing zone associated with the first ramp and made with snow, the first landing zone comprising a first zone and a second zone, wherein:

the first zone defines a first plurality of variable slopes along a first riding direction, the first zone comprises a plurality of segments aligned along the riding direction, each segment extending a length along a dimension, wherein the length along the dimension of each segment is at least one of different from the length along the dimension of a previous segment relative to the riding direction and different from the length along the dimension of a following segment relative to the riding direction, and the plurality of segments comprise:

a first group of segments, wherein the length along the dimension of each segment of the first group of segments is at least one of:

smaller than the length along the dimension of the previous segment relative to that segment along the riding direction, and greater than the length along the dimension of the following segment relative to that segment along the riding direction, and a second group of segments, wherein the length along the dimension of each segment of the second group of segments is at least one of:

greater than the length along the dimension of the previous segment relative to that segment along the riding direction, and smaller than the length along the dimension of the following segment relative to that segment along the riding direction; and a second jumping structure comprising:

a second ramp made with snow and comprising a second transition zone, and a second take-off zone defined by a second take-off angle at a second take-off point of the second take-off zone; and a second landing zone associated with the second ramp and made with snow, the second landing zone comprising a third zone and a fourth zone, wherein the third zone defines a second plurality of variable slopes along a second riding direction, wherein a difference in altitudes between a starting point of the first zone of the first jumping structure and the second take-off point of the second jumping structure is within a range of 10 meters to 40 meters.

13. A method of making a jumping structure comprising:

shaping snow with a snow working tool of a snow groomer vehicle to form:

a ramp comprising a transition zone, and a take-off zone defined by a take-off angle at a take-off point of the take-off zone, and a landing zone associated with the ramp and comprising a first zone and a second zone, wherein:

the first zone defines a plurality of variable slopes along a riding direction, the first zone comprises a plurality of segments aligned along the riding direction, each segment extending a length along a dimension, wherein the length along the dimension of each segment is at least one of different from the length along the dimension of a previous segment relative to the riding direction and different from the length along the dimension of a following segment relative to the riding direction, and the plurality of segments comprise:

a first group of segments, wherein the length along the dimension of each segment of the first group of segments is at least one of:

smaller than the length along the dimension of the previous segment relative to that segment along the riding direction, and greater than the length along the dimension of the following segment relative to that segment along the riding direction, and a second group of segments, wherein the length along the dimension of each segment is at least one of:

greater than the length along the dimension of the previous segment relative to that segment along the riding direction, and smaller than the length along the dimension of the following segment relative to that segment along the riding direction.

14. The method of claim 13, further comprising:

detecting geographic coordinates of the snow groomer vehicle; and forming at least one of the take-off zone and the landing zone by acting on a parameter of the snow working tool based on the detected geographic coordinates.

15. The method of claim 14, further comprising controlling the parameter of the snow working tool based on the detected geographic coordinates and parameter values coupled to geographic coordinate values stored in a memory of a snow groomer vehicle control unit.

16. The method of claim 14, further comprising:

detecting a snow depth at a location of the snow grooming vehicle, and forming at least one of the take-off zone and the landing zone by acting on the parameter of the snow working tool based on at least one of the detected snow depth, the detected geographic coordinates and stored instructions related to working parameters of the parameter of the snow working tool coupled to at least one of snow depth values and geographic coordinate values.

17. The method of claim 14, wherein the method is implemented with a snow grooming vehicle and at least one snow working tool of the snow grooming vehicle.

18. A method of making a jump structure configured to be ridden along a riding direction, the method comprising:

making a ramp comprising a transition zone, and a take-off zone defined by a take-off angle at a take-off point of the take-off zone; and making a landing zone associated with the ramp and comprising a first zone and a second zone, wherein:

the first zone defines a plurality of variable slopes along the riding direction, the first zone comprises a plurality of segments aligned along the riding direction, each segment extending a length along a dimension, wherein the length along the dimension of each segment is at least one of different from the length along the dimension of at least one of a previous segment relative to the riding direction and different from the length along the dimension of a following segment relative to the riding direction, and the plurality of segments comprise:

a first group of segments, wherein each segment of the first group of segments is at least one of:

smaller than the length along the dimension of the previous segment relative to that segment along the riding direction, and greater than the length along the dimension of the following segment relative to that segment along the riding direction, and a second group of segments, each segment of the second group of segments is at least one of:

greater than the length along the dimension of the previous segment relative to that segment along the riding direction, and smaller than the length along the dimension of the following segment relative to that segment along the riding direction.

* * * * *